US005172997A

United States Patent [19]

Brasil

[11] Patent Number: 5,172,997

[45] Date of Patent: Dec. 22, 1992

[54] CONNECTING PIECE FOR SCAFFOLDING

[75] Inventor: John G. Brasil, Mississauga, Canada

[73] Assignee: Etobicoke Ironworks, Ltd., Canada

[21] Appl. No.: 792,029

[22] Filed: Nov. 13, 1991

[30] Foreign Application Priority Data

Apr. 12, 1991 [CA] Canada ..... 2040341

[51] Int. Cl.[5] ..... F16D 1/00

[52] U.S. Cl. ..... 403/4; 403/49; 403/246

[58] Field of Search ..... 403/49, 4, 246, 188

[56] References Cited

U.S. PATENT DOCUMENTS 2,429,753 10/1947 Grosch ..... 403/4
4,587,786 5/1986 Woods ..... 403/49 X
4,840,513 6/1989 Hackett ..... 403/49

FOREIGN PATENT DOCUMENTS 2822676 11/1979 Fed. Rep. of Germany ..... 403/49

*Primary Examiner*—Andrew V. Kundrat

*Attorney, Agent, or Firm*—Anthony J. Casella; Gerald E. Hespos

[57] ABSTRACT

A connecting piece is disclosed for connecting an elongate bracing element to an apertured locking disk on a scaffolding standard. The locking disk is of the sort that is provided with a plurality of apertures spaced around its perimeter. The connecting piece is provided with an upper portion, a lower portion and a slot between the upper and lower portions of suitable width to accommodate insertion of a disk therein. The upper and lower portions are provided with aligned apertures situated to align with an aperture on a disk. The connecting piece is provided with a locking wedge element captive in the apertures of the upper and lower portions and drivable through the aligned apertures of the upper and lower portions and the locking disk. The connecting piece is adapted for attachment to a said brace element, and is characterized in that it is provided with a vertical portion spanning the upper and lower portions at the rear thereof, the vertical portion being provided with a pair of bevelled surfaces extending rearwardly angled at substantially 45° thereto each surface being adapted for connection of a connecting piece to a brace.

6 Claims, 1 Drawing Sheet

CONNECTING PIECE FOR SCAFFOLDING

The present invention relates to the field of construction elements. In particular, the present invention provides a novel connecting piece for use with scaffolding.

The form of scaffolding for which the connecting pieces of the present invention are particularly applicable is shown in, for instance, Canadian Patent No. 1,229,113 dated Nov. 10, 1987 (Woods) or U.S. Pat. No. 4,044,523 (Layher). Each of these patents describes a scaffolding system composed of a plurality of upright standards connected together by horizontal ledgers and diagonal braces. At regular intervals on the vertical standards are located locking disks. Each locking disk is provided with eight regularly spaced apertures around its perimeter. At each end of each ledger and brace, connecting pieces engageable with the locking disk are provided, to connect the ledgers and braces to the standards, and thereby construct the scaffolding. Each said connecting piece has a horizontal slot which will accommodate a locking disk, and a vertical aperture alignable with an aperture on the disk. When the apertures on the connecting piece and the aperture on a disk are aligned, a wedge member may then be driven through the aligned apertures of the connecting piece and the locking disk, to securely lock a ledger or a brace to a standard.

In assembling a scaffolding structure, the standards are set up so that the apertures on the locking disks thereof permit connection of ledgers at rights angles to one another and in line with one another. Accordingly, it will be understood that the connecting pieces attached to the ends of the ledgers may be welded directly thereto, in line with the longitudinal axis of the ledgers. However, it will also be understood that since the ledgers will be occupying the spaces on the locking ring parallel to and perpendicular to the orientation of the scaffolding (i.e., the directions that the ledgers run) Therefore, the spaces on the locking disk into which the diagonal braces must fit are angled 45° outwardly. Since the braces must lie in substantially the same place as the ledgers, it is therefore necessary to angle the connecting pieces at 45° to the longitudinal axis of the diagonal braces. Moreover, in order to attach the braces at a diagonal to the ledgers, the connecting pieces should be pivotally connected thereto. In this way, after one end of a brace is locked to a locking disk, the other end may be manouvered in place by being pivoted upwardly, or downwardly, to an adjacent standard.

In order to effect a 45° connection of the connecting piece with the brace, the brace is flattened at its ends, and bolt holes are drilled in each end. Then, one of two known forms of connecting piece is attached thereto by a bolt, rivet, or other suitable means permitting pivotal motion. In one form of connecting piece, as described in Canadian Patent No. 1,170,694 (Layher) a lug extends out from the connecting piece at 135°. The lug is apertured, and may, therefore, be connected by a nut and bolt or a rivet to the flattened end of a brace.

In the other form of connecting piece, there is no lug provided. Rather, the rearmost surface of the connecting piece is provided with a thickened portion that is angled either to the right or to the left, and provided with a threaded hole to accept a bolt. This is the form of connecting piece that is in the most widespread use. It provides for a very sturdy connection while being fairly compact and easy to manufacture.

A drawback to either of the aforementioned designs for connecting pieces is that they must be manufactured specifically for right or left hand angulation of the end. This is because the connecting piece is not symmetrical from top to bottom, and it is necessary to attach a connecting piece to each end of a brace. It will therefore be understood that utilizing either design of the prior art, it was necessary to manufacture two mirror image connecting pieces for each diagonal brace. This led to higher than expected manufacturing costs, and occasionally to accidentally attaching two "rights" or two "lefts" to one brace. Moreover, it has been advisable that contractors and scaffolding erectors maintain an inventory of left and right oriented connected pieces for field repair of damaged braces.

The object of the present invention is to provide a connecting piece for use with braces for scaffolding of the aforementioned type. The connecting piece provided by the present invention are each suitable for use either as right or left hand connectors so that two identical connectors may be installed on any brace.

In a broad aspect, the present invention relates to a connecting piece for connecting an elongate bracing element to an apertured locking disk on a scaffolding standard, said locking disk being of the sort that is provided with a plurality of apertures spaced around its perimeter, said connecting piece being provided with an upper portion, a lower portion and a slot between said upper and lower portions of suitable width to accommodate insertion of said disk therein, said upper and lower portions being provided with aligned apertures situated to align with an aperture on a said disk, said connecting piece being provided with a locking wedge element captive in said apertures of said upper and lower portions and drivable through the aligned apertures of said upper and lower portions and said locking disk, said connecting piece further being adapted for attachment to a said brace element characterized in that said connecting piece is provided with a vertical portion spanning said upper and lower portions, at the rear thereof, said vertical portion being provided with a pair of bevelled surfaces angled at substantially 45° thereto each surface being adapted for connection of sad connecting piece to a said brace.

In drawings which illustrate the present invention by way of example:

Figure 2:
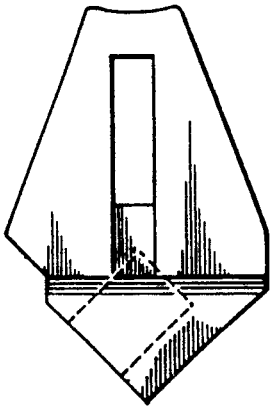
FIG. 2 PRIOR ART
FIG. 2 is a top view of a prior art left handed connector.

Referring now to the drawings, it will be observed that the present invention provides a connecting piece 1 for attachment to a brace B. The connecting piece is provided with a horizontal slot 2 which separates the upper 3 and lower 4 sections of the connecting pieces. Extending through the upper and lower is an aperture which intersects the horizontal slot. It will be observed from the dotted line showing the width of the aperture in the lower sections, in FIG. 3 that in the upper section, the aperture is narrowed at its upper end. A locking wedge 6 is held captive in the slot. At one end of the wedge, there is a retaining rivet, which prevents the wedge from being withdrawn from the upper section (which, as noted above, has a narrowed aperture) but permits the wedge to be withdrawn from the lower section and past the horizontal slot. To install a connecting piece on a brace, therefore, one withdraws the wedge past the horizontal slot, fits the connecting piece onto a locking disk (see FIG. 4) with the disk in the horizontal slot and an aperture on the disk aligned with the vertical aperture on the connecting piece. The wedge is then hammered in tightly, to secure the connecting piece on the locking disk.

Figure 1:
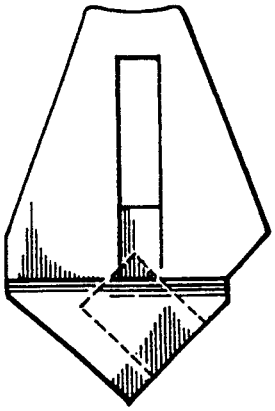
FIG. 1 PRIOR ART
FIG. 1 is a top view of a prior art right handed brace connector.

Referring to FIGS. 1 and 2, it will be observed that prior art connecting pieces are provided in either right or left hand orientation. That is, if one observes the brace end shown in FIG. 4, it is clear that utilizing prior art connectors, one would have to use a FIG. 1 "right hand" connector. It will be understood, moreover, that at the other end of the brace, a FIG. 2 "left hand" connector would be required.

Figure 3:
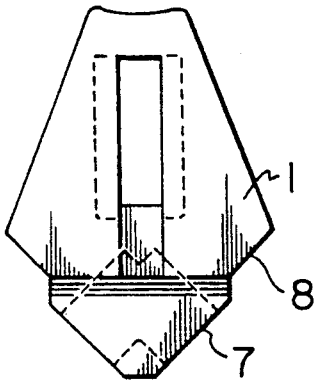
FIG. 3 is a top view of a connector according to the present invention.
Figure 4:
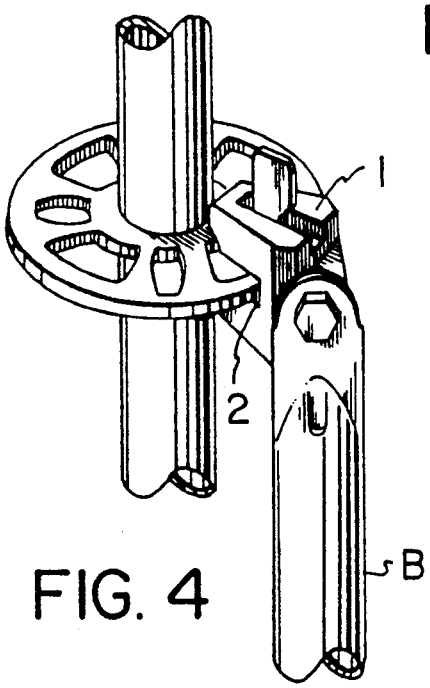
FIG. 4 is a perspective view of a brace attached to a connector according to the present invention on a locking disk.
Figure 5:
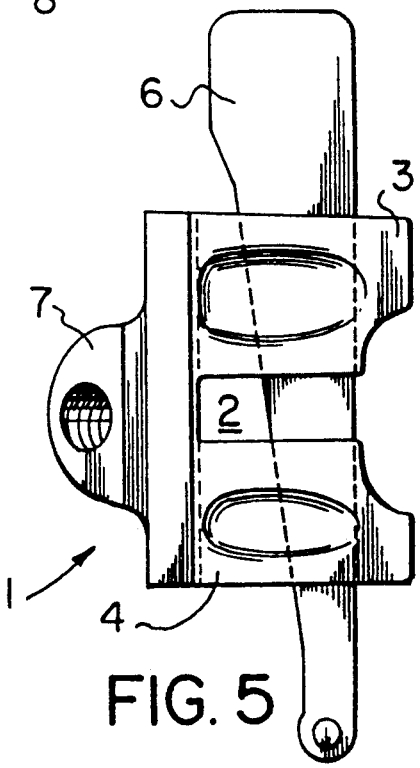
FIG. 5 is a side view of the connecting piece of the present invention.

Referring now to FIG. 3, the present invention provides a connector with a thickened rear portion 7 that is provided with threaded bolt holes on each side, so that it is capable of either right or left hand usage. In order to achieve this result, a thickened portion of slightly greater depth than in prior art connectors is provided, and each face of the thickened portion is bevelled at 45° relative to the orientation of the vertical aperture. Appropriate bevelling of the rearmost corners 8 of the connecting pieces, so that they do not interfere with the attachment of a brace to the connecting piece is also done. Lastly, a bolt hole is formed in each said face of the thickened portion. The applicant has found that it is not a concern if the bolt holes intersect, as long as at least five full threads are available in each hole for a bolt to be threaded therein.

It is to be understood that the examples described above are not meant to limit the scope of the present invention. It is expected that numerous variants will be obvious to the person skilled in the scaffolding design and manufacture field, without any departure from the spirit of the invention. The appended claims, properly construed, form the only limitation upon the scope of the present invention.

I claim:

1. A connecting piece for connecting an elongate bracing element to an apertured locking disk on a scaffolding standard, said locking disk being of the sort that is provided with a plurality of apertures spaced around its perimeter, said connecting piece being provided with an upper portion, a lower portion and a slot between said upper and lower portions of suitable width to accommodate insertion of said disk therein, said upper and lower portions being provided with aligned apertures situated to align with an aperture on a said disk, said connecting piece being provided with a locking wedge element captive in said apertures of said upper and lower portions and drivable through the aligned apertures of said upper and lower portions and said locking disk, said connecting piece being adapted for attachment to a said brace element, characterized in that said connecting piece is provided with a vertical portion spanning said upper and lower portions at the rear thereof, said vertical portion being provided with a pair of bevelled surfaces extending rearwardly angled at substantially 45° thereto each surface being adapted for connection of said connecting piece to a said brace.

2. A connecting piece as claimed in claim 1, wherein said bevelled surfaces are the rearmost surfaces of a thickened portion of said vertical spanning portion.

3. A connecting piece as claimed in claim 2, wherein the rearmost corners of said upper and lower portions are also bevelled, to provide clearance for a said bracing element attached to a said bevelled surface.

4. A connecting piece as claimed in claim 2, wherein each said bevelled surface is provided with a threaded hole to accept a bolt, whereby a said bracing element may be bolted to a said bevelled surface.

5. A connecting piece as claimed in claim 4, wherein each threaded hole is provided with at least five full threads.

6. A connecting piece as claimed in claim 2, wherein each bevelled surface is provided with a threaded stud extending therefrom at right angles to the respective bevelled surface, whereby a said stud may engage an aperture in a said bracing element and the secured thereto with a nut.

* * * * *